US006024384A

United States Patent [19]

Jones et al.

[11] Patent Number: 6,024,384

[45] Date of Patent: Feb. 15, 2000

[54] CLIPBOARD WITH CARD ATTACHMENT

[75] Inventors: Robert A. Jones; Jeneen Preciose, both of Raleigh, N.C.

[73] Assignee: Adstracts, Inc., Raleigh, N.C.

[21] Appl. No.: 09/103,275

[22] Filed: Jun. 23, 1998

[51] Int. Cl.[7] ..... B42D 3/00

[52] U.S. Cl. ..... 281/45; 281/42; 281/51; 248/452

[58] Field of Search ..... 281/42, 45; 116/239; 248/441.1, 452; 24/67 R, 67.3, 67.5, 67.7, 67.9, 67.11; 40/404; 283/36

[56] References Cited

U.S. PATENT DOCUMENTS

| | | | |
|---|---|---|---|
| D. 285,938 | 9/1986 | Ventres, Jr. | D19/1 |
| 792,747 | 6/1905 | Anderson et al. | 402/79 |
| 860,514 | 7/1907 | Batten et al. | 402/79 |
| 860,645 | 7/1907 | Dobbins | 402/79 |
| 954,102 | 4/1910 | Hutchings . | |
| 1,107,351 | 8/1914 | Proudfit | 402/79 |
| 1,215,643 | 2/1917 | Fuller . | |
| 1,324,283 | 12/1919 | Stone . | |
| 2,776,149 | 1/1957 | Hobbs | 281/15 |
| 4,173,358 | 11/1979 | Wilson | 281/45 |
| 4,955,576 | 9/1990 | Moberg | 248/449 |
| 5,015,114 | 5/1991 | Miller | 402/4 |
| 5,020,931 | 6/1991 | Sloot | 402/79 |
| 5,116,012 | 5/1992 | Offenhauer et al. | 248/452 |
| 5,180,133 | 1/1993 | Chang | 248/452 |
| 5,413,382 | 5/1995 | Cornell, Jr. | 281/45 |
| 5,553,959 | 9/1996 | Feldman et al. | 402/79 |
| 5,555,606 | 9/1996 | Chu | 24/67.9 |
| 5,572,815 | 11/1996 | Kovner | 40/404 |
| 5,732,925 | 3/1998 | Shamoon | 248/452 |
| 5,749,667 | 5/1998 | Feldman et al. | 402/79 |
| 5,758,902 | 6/1998 | McManus | 281/45 |
| 5,888,011 | 3/1999 | Reinbold, Jr. | 402/70 |

FOREIGN PATENT DOCUMENTS

| | | |
|---|---|---|
| 448072 | 4/1948 | Canada . |

*Primary Examiner*—Willmon Fridie, Jr.
*Assistant Examiner*—Alisa Thurston
*Attorney, Agent, or Firm*—Myers Bigel Sibley & Sajovec, P.A.

[57] ABSTRACT

A clipboard includes a planar panel suitable for writing and holding documents and a retaining member pivotally secured thereto that is configured to have Rolodex®-style cards releasably secured to a front surface thereof. A pair of adjacent, spaced-apart card retaining rails are secured to the retaining member front face. One or more cards are releasably secured to the card retaining rails via a pair of complementary shaped notches. Each card includes opposite first and second faces with printed indicia on at least one of the first and second faces. Each card is also movable along the retaining rails from a first position wherein the first face is exposed to a second position wherein the second face is exposed.

19 Claims, 4 Drawing Sheets

CLIPBOARD WITH CARD ATTACHMENT

FIELD OF THE INVENTION

The present invention relates generally to clipboards and, more particularly, to multi-functional clipboards.

BACKGROUND OF THE INVENTION

Clipboards are often used by medical and other technical personnel-to prepare and hold documents. Clipboards typically include a clamping mechanism for securing paper to a hard flat surface suitable for writing upon. The primary advantage of conventional clipboards is that they provide a suitable surface for preparing written documents in situations where other suitable surfaces are not available. For example, medical personnel typically require the use of a clipboard when preparing patient records, prescriptions and other medical documents. Typically, medical personnel are standing or sitting near a patient without the convenience of a desk or table surface. Similarly, other technical personnel often utilize a clipboard in the field when servicing equipment and the like.

Documents carried around with a clipboard are typically secured thereto using the clipboard's clamping mechanism. To write upon paper secured to a clipboard, any documents already secured to the clipboard must be raised up to permit access to the paper or must be moved behind the paper being written upon. Accordingly, writing on paper secured to a clipboard and accessing information in other documents secured to a clipboard may be somewhat cumbersome. Furthermore, searching for information in documents clamped to a clipboard in a conventional manner may be somewhat cumbersome.

SUMMARY OF THE INVENTION

In light of the above discussion, it is an object of the present invention to provide clipboards that allow users to quickly and easily access information within documents attached thereto.

It is another object of the present invention to provide clipboards that allow users to simultaneously write upon paper secured thereto and to access information within documents attached thereto.

These and other objects of the present invention are provided by a clipboard including a planar panel suitable for writing and holding documents and a retaining member pivotally secured thereto that is configured to have Rolodex®-style cards (Insilco Corporation, 300 North Marienfield, Midland, Tex.) releasably secured to a front surface thereof. A spring biases the retaining member against the clipboard panel to securely retain documents placed therebetween. A pair of adjacent, spaced-apart card retaining rails are secured to the retaining member front face. The card retaining rails comprise an arcuate configuration with a T-shaped or L-shaped cross section.

One or more Rolodex®-style cards are releasably secured to the card retaining rails via a pair of complementary shaped notches. Each card includes opposite first and second faces with printed indicia on at least one of the first and second faces. Each card is also movable along the retaining rails from a first position wherein a first face is exposed to a second position wherein a second face is exposed.

The present invention combines the utility of a clipboard with the convenience of ready access to various information. The cards releasably secured to the retaining rails, according to the present invention, may include various types of information, such as names, telephone numbers, and the like. Information that a user would otherwise have to carry around in separate documents or in documents secured to a clipboard via the clamping mechanism, are readily available via the present invention.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

Figure 1:
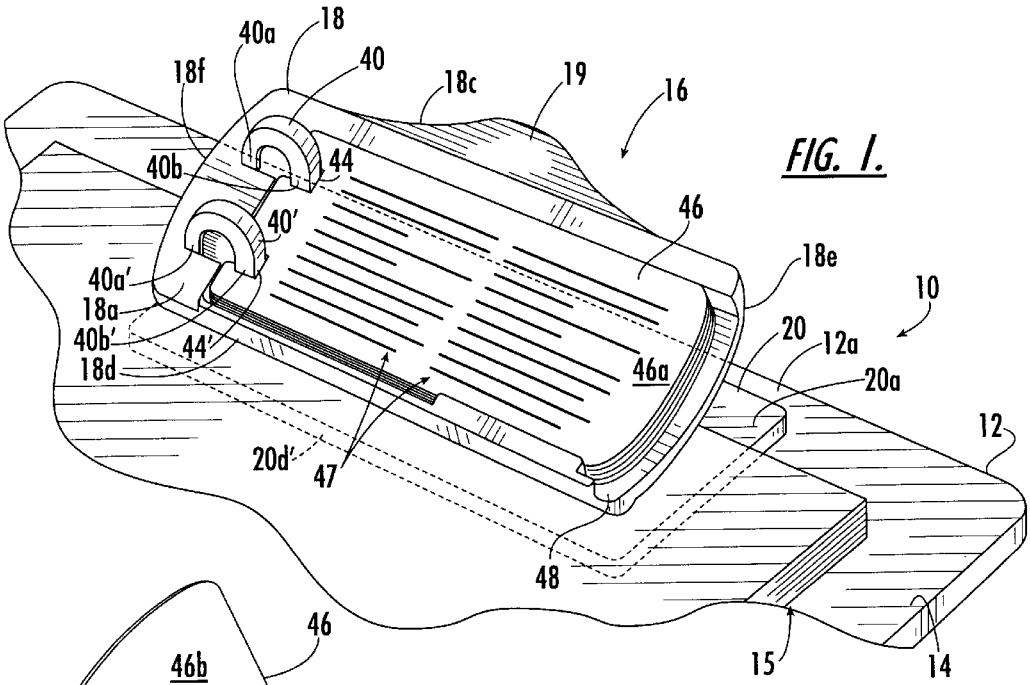
FIG. 1 is a partial perspective view of a clipboard incorporating a clamping mechanism according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to FIGS. 1–5, a clipboard 10, according to an embodiment of the present invention, is illustrated. The clipboard 10 includes a rigid, planar panel 12 having a front surface 14 which is preferably suitable for writing and holding documents 15 thereto. A clamping mechanism 16 for securely holding documents to the front surface 14 of the clipboard panel 12 is preferably mounted to the clipboard panel front surface 14 along an end portion 12*a* of the panel 12, as illustrated.

Figure 3:
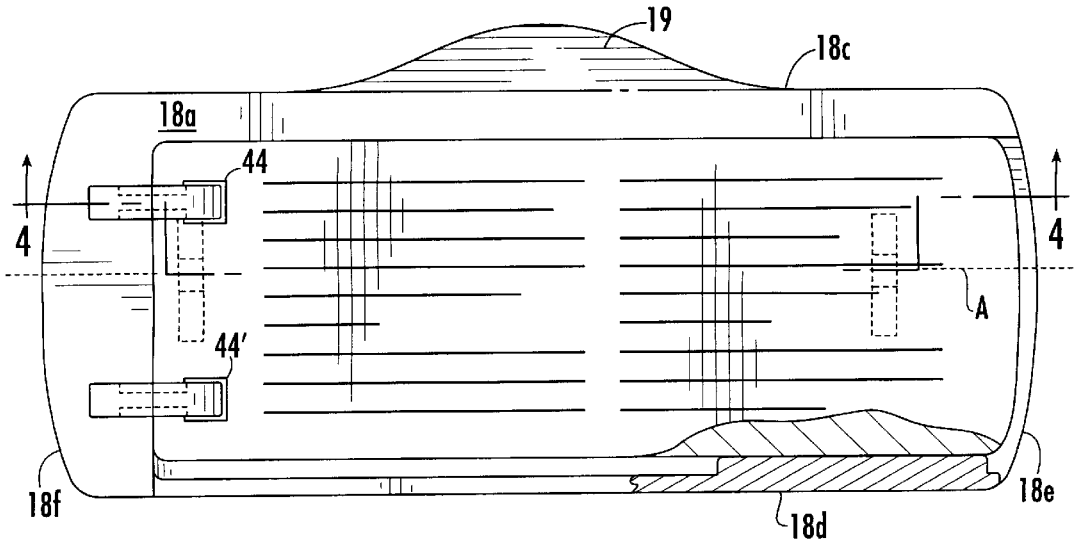
FIG. 3 is a plan view of the clamping mechanism of FIG. 1.
Figure 4:
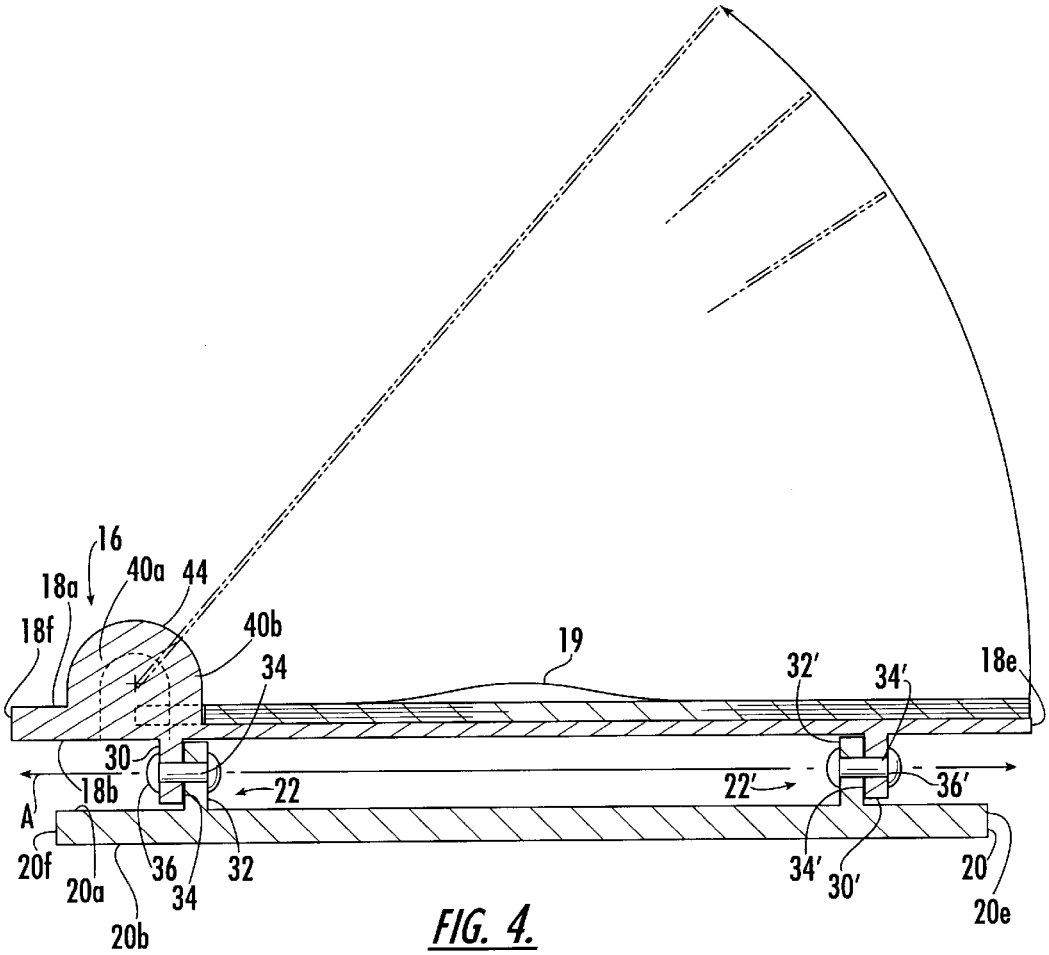
FIG. 4 is a section view taken along lines 4—4 of FIG. 3.
Figure 5:
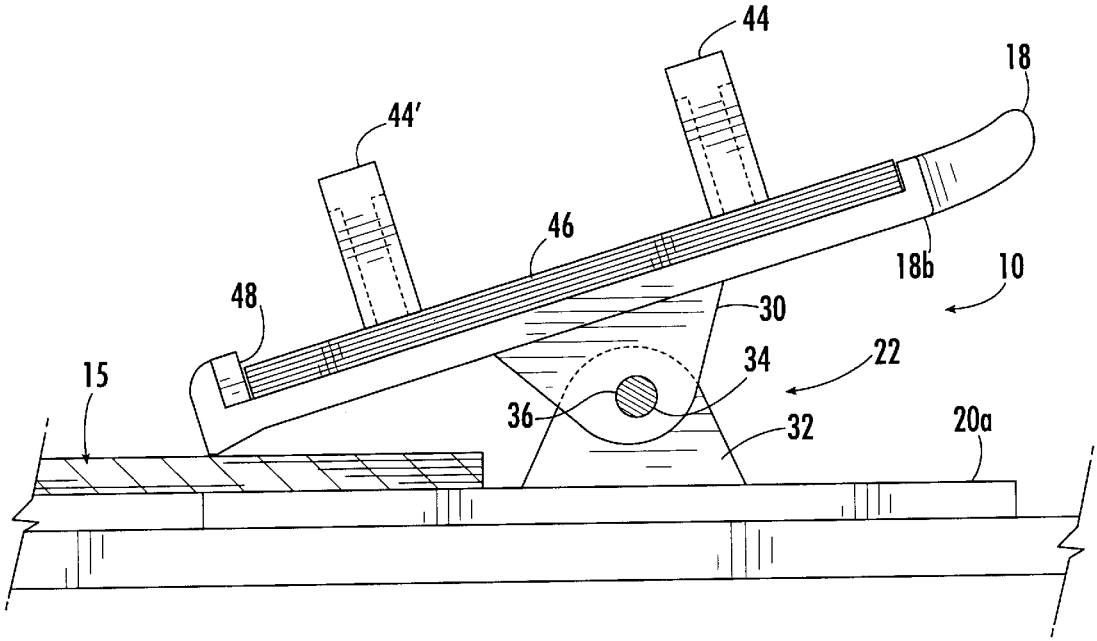
FIG. 5 is a side elevation view of the clipboard of FIG. 1 illustrating the clamping mechanism securing a plurality of documents to the clipboard.

The clamping mechanism 16 includes a rigid retaining member 18 movably mounted to a rigid base member 20 via hinges 22, 22' for pivotal movement about an axis (indicated by arrow A in FIGS. 3 and 4). The illustrated retaining member 18 has a generally rectangular configuration and includes opposite first and second faces 18*a*, 18*b*, opposite edge portions 18*c*, 18*d* and opposite end portions 18*e*, 18*f*.

The illustrated base member 20 has a generally rectangular configuration and includes opposite first and second faces 20*a*, 20*b*, opposite edge portions 20*c*, 20*d* and opposite end portions 20*e*, 20*f*. The base member 20 may be secured to the panel front surface 14 in various ways, known to those skilled in this art. The base member 20 may also be positioned within a recess formed in the panel front surface 14 to provide a substantially flush configuration with the planar panel 12.

A lever 19 extends from retaining member edge portion 18*c*, as illustrated. The lever 19 is configured such that a user can exert pressure thereagainst to pivot the retaining member 18 about the pivot axis A, such that retaining member edge portion 18*d* separates from the base member edge portion 20*d*.

The retaining member edge portion 18*d* is biased towards the base member edge portion 20*d* via one or more springs as would be understood by those skilled in this art. It is to be understood that various ways of biasing the retaining member edge portion 18*d* towards the base member edge portion 20*d* may be utilized, and are well known in the art. Preferably, the retaining member 18 is biased with sufficient force to retain documents inserted between the retaining member edge portion 18*d* and the base member edge portion 20*d*.

Figure 8:
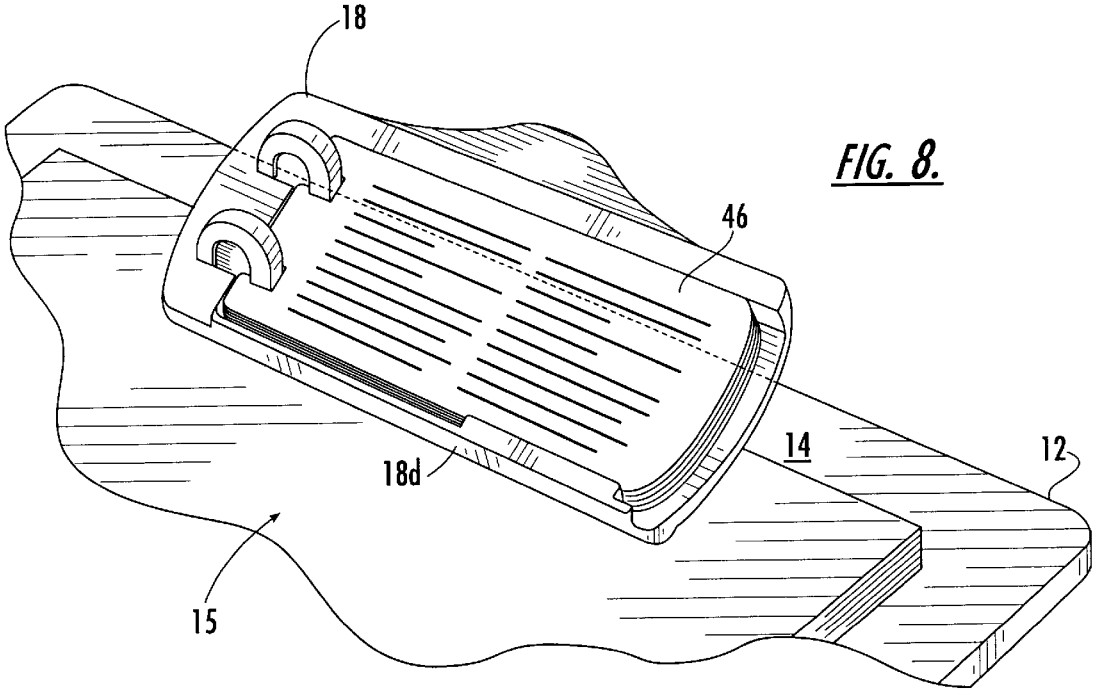
FIG. 8 is a partial perspective view of a clipboard incorporating a clamping mechanism according to another embodiment of the present invention, wherein the clamping mechanism is mounted directly to the clipboard.

In an alternative embodiment, as illustrated in FIG. 8, the retaining member 18 may be movably secured to the panel 12, without a base member. The retaining member edge portion 18*d* is biased towards the panel front surface 14. Accordingly, documents are secured between the retaining member edge portion 18*d* and the panel front surface 14.

Referring back to the illustrated embodiment of FIGS. 1–5, and FIG. 4 in particular, hinge 22 includes a first member 30 depending from the retaining member second face 18*b* and a second member 32 extending from the base member first face 20*a*. The first and second members 30, 32 of hinge 22 each include respective apertures 34 that are configured to receive a pin 36 therethrough when aligned, as illustrated. Similarly, hinge 22' includes a first member 30' depending from the retaining member second face 18*b* and a second member 32' extending from the base member first face 20*a*.

The first and second members 30', 32' of hinge 22' include respective apertures 34' configured to receive a pin 36' therethrough when aligned, as illustrated. The retaining member 18 is pivotable about the pivot axis A via the respective pins 36, 36' as illustrated. It is to be understood that the retaining member 18 may be pivotally mounted to the base member 20, or to the planar panel 12, in various ways, and is not limited to the illustrated embodiment. Furthermore, various types and configurations of clamping mechanisms may be utilized with the present invention, without limitation.

A pair of adjacent, spaced-apart card retaining rails 40, 40' are secured to the retaining member first face 18*a*, as illustrated. Each of the card retaining rails 40, 40' has a cross-sectional configuration for releasably engaging respective complementary-shaped notches 44, 44' within one or more cards 46. The configuration of the rails 40, 40' and corresponding notches 44, 44' holds the cards 46 against unintended separation from the rails 40, 40' .as is understood by those skilled in this art. Preferred cards 46 are Rolodex®-style cards; however, various types of cards may be utilized.

Figure 6:
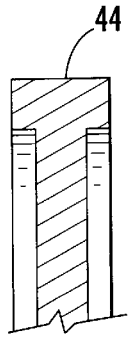
FIGS. 6 and 7 illustrate exemplary cross-sectional shapes of the card retaining rails.
Figure 7:
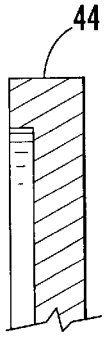

In the illustrated embodiment of FIGS. 1–5, each of the card retaining rails 40, 40' has a generally T-shaped cross-section. This T-shaped cross-section is illustrated in greater detail in FIG. 6. However, it is to be understood that card retaining rails may have various cross-sectional configurations and shapes. For example, each card retaining rail 40, 40' may have an L-shaped cross-section as illustrated in FIG. 7.

Figure 2:
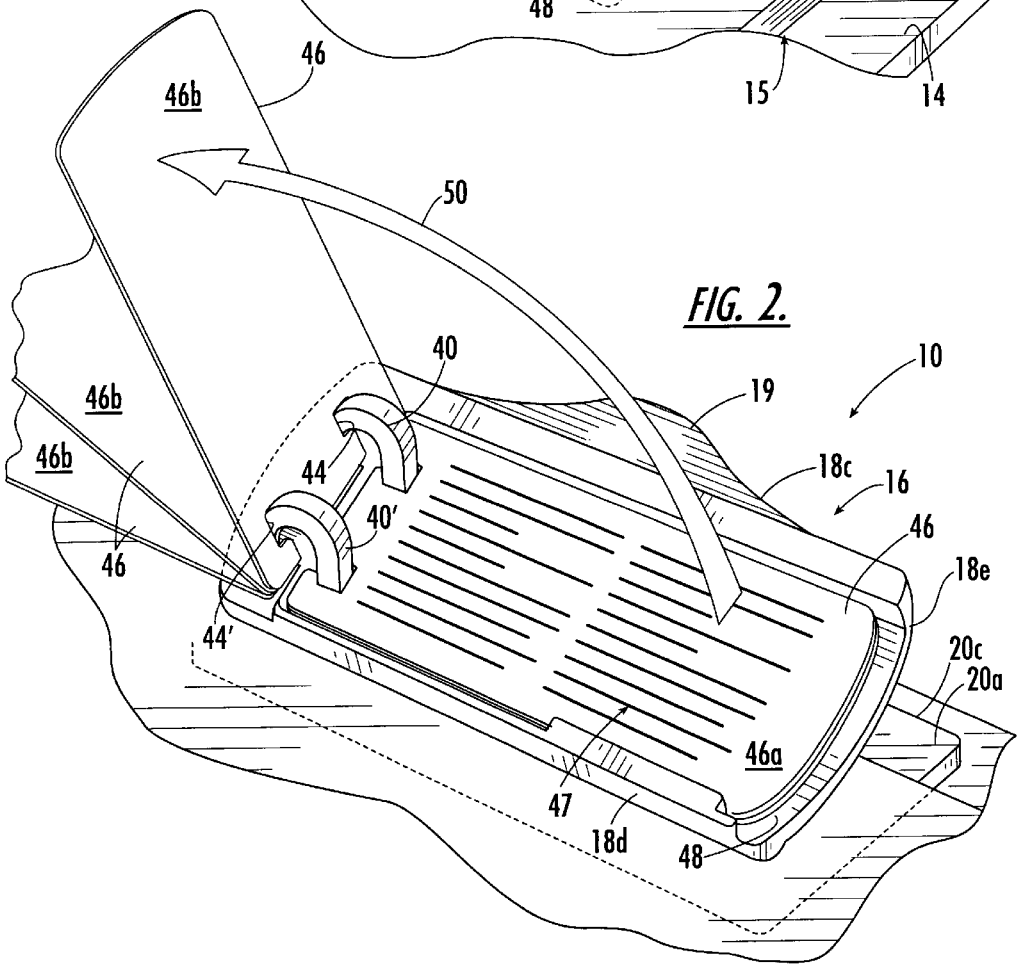
FIG. 2 illustrates a plurality of cards releasably engaging a set of rails mounted on the clamping mechanism of FIG. 1, according to the present invention.

In the illustrated embodiment of FIGS. 1–5, each of the card retaining rails 40, 40' have a generally arcuate configuration such that cards 46 releasably secured thereto are movable along the rails 40, 40' from a first position to a second position (indicated by arrow 50 in FIG. 2). In a first position, a first face 46*a* of a card is exposed, as illustrated in FIG. 1. In a second position an opposite second face 46*b* of a card is exposed, as illustrated in FIG. 2. As would be understood by those skilled in this art, printed indicia 47 may be provided on either or both of the first and second faces 46*a*, 46*b* of a card 46.

In the illustrated embodiment, each rail 40, 40' includes respective opposite ends 40*a*, 40*b* and 40*a'*, 40*b'* secured to the retaining member first face 18*a*. Each of the rails 40, 40' defines a direction extending between opposite ends 40*a*, 40*b* and 40*a'*, 40*b* ' that is substantially parallel with the pivot axis A and with retaining member edge portion 18*d*.

In the illustrated embodiment, the retaining member 18 also includes a recessed portion 48 formed in the first face 18*a* adjacent the pair of card retaining rails 40, 40', as illustrated. The recessed portion 48 is configured to receive one or more cards 46 therein. Preferably, the recessed portion 48 is configured to maintain the cards 46 in a substantially flush configuration within the retaining member 18. However, it is to be understood that the recessed portion 48 is an optional feature of the present invention and may have various shapes and configurations.

The panel 12, retaining member 18, card retaining rails 40, 40' and base member 20 may be formed from various materials including polymeric materials, metal, and wood. Particularly preferred are polymeric materials. Various techniques, known to those skilled in the art of polymeric material forming operations, may be utilized in forming the panel 12, retaining member 18 and base member 20 from polymeric materials, including, but not limited to molding, injection molding and extrusion.

The above described clamping mechanism 16 is not limited to use with clipboards. Clamping mechanisms incorporating card retaining rails and cards releasably secured thereto according to the present invention may be utilized in various applications. For example, clamping mechanisms according to the present invention may be attached to filing cabinets, walls, doors, and the like. Adhesives, magnets and other attachment means may be utilized, without limitation, for attaching clamping mechanisms according to the present invention to various objects. Accordingly, when used in non-clipboard applications, clamping mechanisms according to the present invention combine the utility of a document clamping device with the convenience of ready access to various information contained within cards releasably secured to card retaining rails thereon. Thus, information that a user would otherwise have to carry around can be readily available via the present invention.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A clipboard, comprising:

a planar panel suitable for writing and holding documents;

a base member secured to said panel;

a retaining member including a front face and an edge portion, said retaining member movably secured to said base member for pivotal movement about an axis;

means for biasing said retaining member about said axis such that said retaining member edge portion is biased towards said base member to retain documents placed therebetween;

a pair of adjacent, spaced-apart card retaining rails extending outwardly from said retaining member front face in a direction substantially normal to said retaining member front face, wherein each retaining rail has an arcuate configuration with opposite ends secured to said retaining member front face, and wherein each rail has a cross-sectional shape that is configured to cooperate with a complementary-shaped notch in a card; and at least one card releasably secured to said card retaining rails via a pair of complementary-shaped notches in said at least one card, wherein said at least one card comprises opposite first and second faces, and wherein said at least one card is movable along said retaining rails from a first position wherein said card first face is exposed to a second position wherein said card second face is exposed.

2. A clipboard according to claim 1 wherein each of said card retaining rails has a T-shaped cross-sectional shape.

3. A clipboard according to claim 1 wherein each of said card retaining rails has an L-shaped cross-sectional shape.

4. A clipboard according to claim 1 further comprising a recess formed within said retaining member front face adjacent said retaining rails, said recess configured to receive said at least one card in said first position.

5. A clipboard according to claim 1 wherein said at least one card comprises a plurality of cards.

6. A clipboard according to claim 1 wherein said biasing means comprises a spring.

7. A clipboard, comprising:

a planar panel suitable for writing and holding documents;

a retaining member including a front face and an edge portion, said retaining member movably secured to said panel for pivotal movement about an axis;

means for biasing said retaining member about said axis such that said retaining member edge portion is biased towards said panel to retain documents placed therebetween;

a pair of adjacent, spaced-apart card retaining rails extending outwardly from said retaining member front face in a direction substantially normal to said retaining member front face, wherein each retaining rail has an arcuate configuration with opposite ends secured to said retaining member front face, and wherein each rail has a cross-sectional shape that is configured to cooperate with a complementary-shaped notch in a card; and at least one card releasably secured to said card retaining rails via a pair of complementary-shaped notches in said at least one card, wherein said at least one card comprises opposite first and second faces, and wherein said at least one card is movable along said retaining rails from a first position wherein said card first face is exposed to a second position wherein said card second face is exposed.

8. A clipboard according to claim 7 wherein each of said card retaining rails has a T-shaped cross-sectional shape.

9. A clipboard according to claim 7 wherein each of said card retaining rails has an L-shaped cross-sectional shape.

10. A clipboard according to claim 7 further comprising a recess formed within said retaining member front face adjacent said retaining rails, said recess configured to receive said at least one card in said first position.

11. A clipboard according to claim 7 wherein said at least one card comprises a plurality of cards.

12. A clipboard according to claim 7 wherein said biasing means comprises a spring.

13. A document clamping apparatus, comprising:

a base member;

a retaining member including a front face and an edge portion, said retaining member movably secured to said base member for pivotal movement about an axis;

means for biasing said retaining member about said axis such that said retaining member edge portion is biased towards said base member to retain documents placed therebetween; and a pair of adjacent, spaced-apart card retaining rails extending outwardly from said retaining member front face in a direction substantially normal to said retaining member front face, wherein each retaining rail has an arcuate configuration with opposite ends secured to said retaining member front face, and wherein each rail has a cross-sectional shape that is configured to cooperate with a complementary-shaped notch in a card.

14. A document clamping apparatus according to claim 13 further comprising at least one card releasably secured to said card retaining rails via a pair of complementary-shaped notches in said at least one card, wherein said at least one card comprises opposite first and second faces, and wherein said at least one card is movable along said retaining rails from a first position wherein said card first face is exposed to a second position wherein said card second face is exposed.

15. A document clamping apparatus according to claim 13 wherein each of said card retaining rails has a T-shaped cross-sectional shape.

16. A document clamping apparatus according to claim 13 wherein each of said card retaining rails has an L-shaped cross-sectional shape.

17. A document clamping apparatus according to claim 13 further comprising a recess formed within said retaining member front face adjacent said retaining rails, said recess configured to receive said at least one card in said first position.

18. A document clamping apparatus according to claim 14 wherein said at least one card comprises a plurality of cards.

19. A document clamping apparatus according to claim 13 wherein said biasing means comprises a spring.

* * * * *